US006755179B2

(12) United States Patent
Asakawa

(10) Patent No.: US 6,755,179 B2
(45) Date of Patent: Jun. 29, 2004

(54) FUEL INJECTION SYSTEM

(75) Inventor: Yasunori Asakawa, Toyota (JP)

(73) Assignee: Denso Corporation, Kariya (JP)

( * ) Notice: Subject to any disclaimer, the term of this patent is extended or adjusted under 35 U.S.C. 154(b) by 16 days.

(21) Appl. No.: 10/342,332

(22) Filed: Jan. 15, 2003

(65) Prior Publication Data

US 2003/0131823 A1 Jul. 17, 2003

(30) Foreign Application Priority Data

Jan. 15, 2002 (JP) ..... 2002-005931

(51) Int. Cl.[7] ..... F02D 41/06; F02D 41/24

(52) U.S. Cl. ..... 123/436; 123/478; 123/491; 701/113; 701/110; 701/104

(58) Field of Search ..... 123/435, 436, 123/478, 491, 492, 493; 701/104, 110, 113

(56) References Cited

U.S. PATENT DOCUMENTS

| | | | | |
|---|---|---|---|---|
| 4,495,920 A | | 1/1985 | Matsumura et al. | 123/436 |
| 4,590,907 A | | 5/1986 | Tsukamoto et al. | 123/357 |
| 4,705,000 A | | 11/1987 | Matsumura et al. | 123/357 |
| 5,845,624 A | * | 12/1998 | Ajima | 123/494 |
| 6,209,519 B1 | | 4/2001 | Melchior et al. | 123/436 |

FOREIGN PATENT DOCUMENTS

| | | | | |
|---|---|---|---|---|
| EP | 1162358 A2 | | 12/2001 | |
| EP | 1327764 | * | 7/2003 | F02D/41/34 |
| JP | 60-184948 | | 9/1985 | |
| JP | 2001-355500 | | 12/2001 | |

* cited by examiner

*Primary Examiner*—Hai Huynh
(74) *Attorney, Agent, or Firm*—Nixon & Vanderhye P.C.

(57) ABSTRACT

A fuel injection system for multi-cylinder engine has an ECU for controlling respective fuel injection amount for cylinders. The ECU adjusts each of fuel injection amounts to suppress engine revolution speed change and engine vibration caused by differences of combustion power between cylinders. The vibration suppressing control is carried out on the basis of injection correction amounts that is calculated based on deviation of the engine revolution speed in each engine cylinder. The ECU stores the injection correction amounts in a two-dimensional map defined by a cooling water temperature and a fuel temperature. In the case of an initiation of the control, the ECU looks up the map to obtain an initial value in accordance with a present temperature condition of the engine. It is possible to start or resume the control from a proper level of the injection correction amount.

14 Claims, 6 Drawing Sheets

FIG. 6

#4 CYLINDER : Σ Δqk0i

#3 CYLINDER : Σ Δqk0i

#2 CYLINDER : Σ Δqk0i

#1 CYLINDER : Σ Δqk0i

| thw(n) \ thf(m) | m1 | m2 | m3 | m4 |
|---|---|---|---|---|
| n1 | Σ Δqk0i | · | · | · |
| n2 | · | · | · | · |
| n3 | · | · | · | · |
| n4 | · | · | · | Σ Δqk0i |

FUEL INJECTION SYSTEM

CROSS REFERENCE TO RELATED APPLICATION

This application is based on Japanese Patent Application No. 2002-5931 filed on Jan. 15, 2002 the contents of which are incorporated herein by reference.

BACKGROUND OF THE INVENTION

1. Field of the Invention

The present invention relates to a fuel injection system for an internal combustion engine.

2. Description of Related Art

Usually, in a multi-cylinder type diesel engine (hereinafter referred to as "engine"), there occurs engine vibration due to an engine revolution speed change in each combustion stroke in each cylinder which is caused by variations in combustion power between the cylinders. Particularly, in an unloaded state of the engine, i.e., in a stable idling state, vibration and noise of the engine may offend a driver. It is known that an engine revolution speed change between cylinders in the engine occurs due to variations in fuel injection amount and combustion factor in the engine between cylinders which are caused by a difference between individual injectors for cylinders.

In view of this point and for the purpose of diminishing an engine revolution speed change between cylinders to decrease engine vibration in the whole of the engine there has been conducted a non-uniform fuel amount compensating control. In the non-uniform fuel amount compensating control, an engine revolution speed change in each combustion stroke in each of the engine cylinders is detected and the fuel injection amount is adjusted to an optimum injection amount for each of the cylinders so as to smooth the engine revolution speed change between the cylinders. According to the non-uniform fuel amount compensating control, when a cylinder-by-cylinder injection correction amount updating (reflecting) condition is existent, an engine revolution speed change in each combustion stroke in each engine cylinder is detected and the detected value is compared with a mean value of engine revolution speed changes in all the cylinders, then the injection correction amount for each cylinder is updated so as to smooth the engine revolution speed change between the cylinders. The updated value of the injection correction amount is stored to compensate the fuel injection amount for each of the engine cylinders. This control is also called as a FCCB learning control or a FCCB control and the cylinder-by-cylinder injection correction amount updating condition is also called as a FCCB condition.

However, in a fuel injection system employing the FCCB control, when the FCCB condition has changed from existence to non-existence, the injection correction amount for each cylinder of the last time in the condition existence is held until the FCCB condition revives. But, in case of a change of the temperature environment, including engine temperature and/or fuel temperature, during non-existence of the FCCB condition, giving rise to a difference in engine revolution speed change between cylinders. Therefore, there arises the problem that engine vibration offends the driver until the injection correction amount for each cylinder is again updated after the FCCB condition revives.

SUMMARY OF THE INVENTION

It is an object of the present invention to provide a fuel injection system that is capable of compensating an engine operating condition change during the FCCB condition was not established.

It is another object of the present invention to provide a fuel injection system capable of suppressing engine vibration from an initial stage in the case where the FCCB condition was not existent last time but is existent this time.

According to the invention, when the FCCB condition has been existent from the last time, an engine revolution speed change in each cylinder is detected based on both a maximum engine revolution speed and a minimum engine revolution speed in each combustion stroke in each cylinder. Subsequently, a deviation of the engine revolution speed change in each cylinder is calculated based on both the detected value of the engine revolution speed change in each cylinder and a mean value of engine revolution speed changes in all cylinders.

Then, in accordance with the deviation of the engine revolution speed change in each cylinder, an injection correction amount for each cylinder is updated so as to smooth the engine revolution speed change between cylinders. Two temperature conditions, which are an engine temperature detected by an engine temperature detecting means and a fuel temperature detected by a fuel temperature detecting means are inputted. The injection correction amount for each cylinder updated by a correction amount updating means is stored in a correction amount storage means as an injection correction amount for each cylinder corresponding to the two temperature conditions.

When the FCCB condition was not existent last time but is existent this time, an initial injection correction amount for each cylinder is calculated based on the injection correction amount for each cylinder stored in the storage means in accordance with the two temperature conditions. The initial injection correction amount is obtained based on present values of the engine temperature and the fuel temperature.

Therefore, even if the temperature environment had been changed while non-existence of the FCCB condition, the FCCB control can be resumed on the basis of the initial injection correction amount for each cylinder. Since the initial injection correction amount has been stored in accordance with the temperature condition, it is possible to suppress engine vibration and noise of the engine.

According to another aspect of the present invention, the FCCB control for smoothing the engine revolution speed may be performed when the engine revolution speed is a predetermined value or less. For example, the FCCB control may be performed in an idling condition of the engine.

According to still another aspect of the present invention, the FCCB control may be performed when the vehicle running speed is a predetermined value or less.

In addition, the storage means may storage initial values that are set in a manufacturing process. The initial injection correction amount may be obtained in several situations that meets the condition in which the FCCB condition was not existent last time but is existent this time. For example, the initial injection correction amount may be obtained when the FCCB condition is established for the first time after start-up of the engine. For example, the initial injection correction amount may be obtained when the FCCB condition is established just after the engine has stared under cold condition after the engine has stopped under completely warmed-up condition. For example, the initial injection correction amount may be obtained when the FCCB condition is established after the vehicle has traveled just after the engine has started under a cold condition.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

FIG. 6 is a chart showing maps according to the first embodiment of the present invention.

DETAILED DESCRIPTION OF PREFERRED EMBODIMENTS

Figure 1:
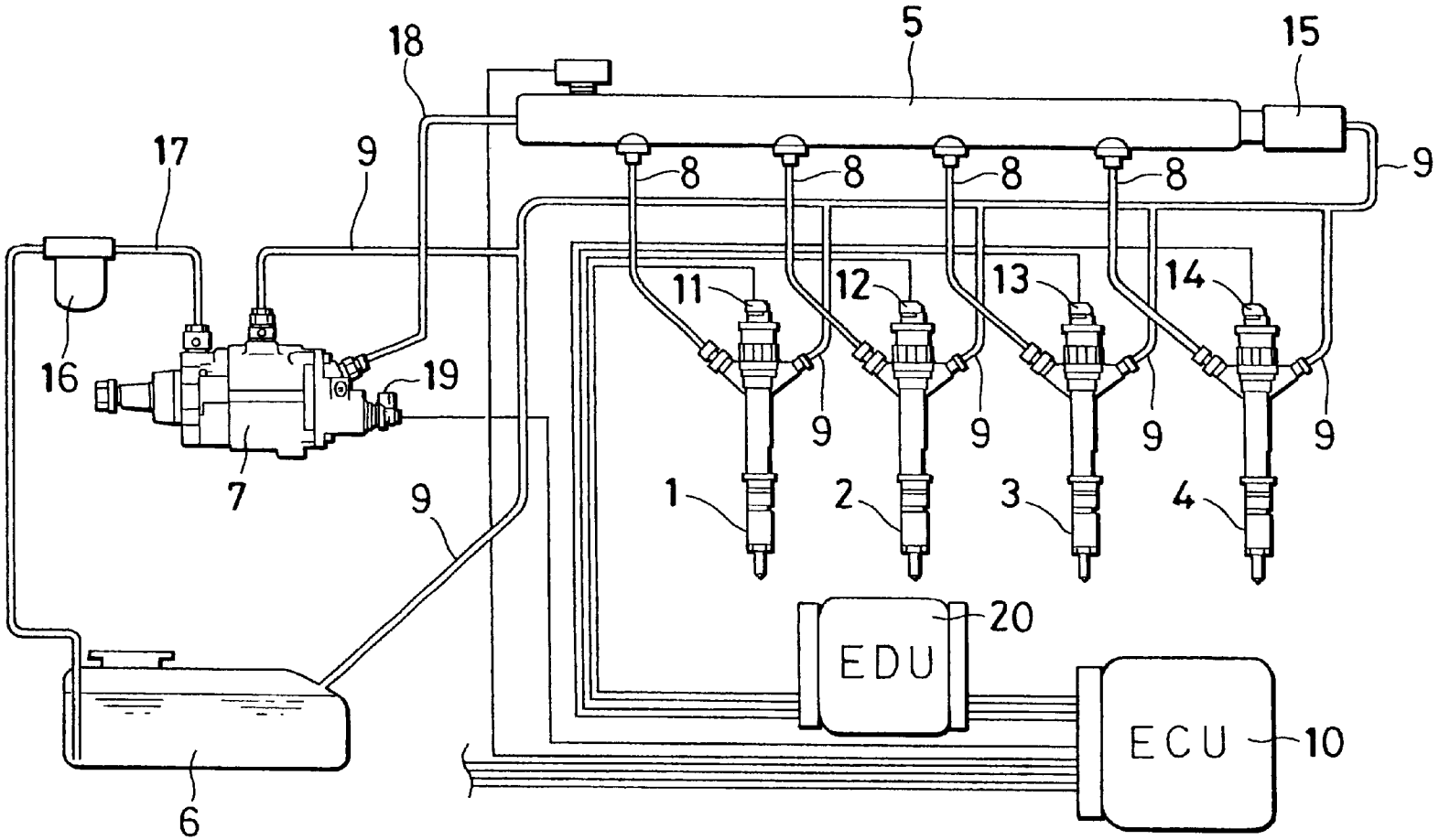
FIG. 1 is a block diagram showing an entire construction of a common rail type fuel injection system according to a first embodiment of the present invention.
Figure 2:
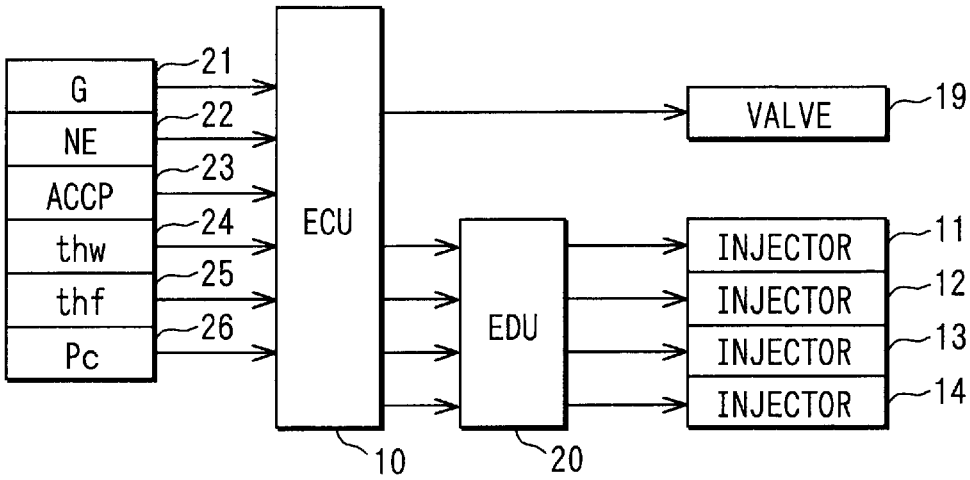
FIG. 2 is a block diagram showing a control system of the fuel injection system according to the first embodiment of the present invention.

FIGS. 1 to 7 illustrate an embodiment of the present invention. FIG. 1 illustrates an entire construction of a common rail type fuel injection system applied with the present invention. FIG. 2 illustrates a schematic construction of an injection amount control unit in the common rail type fuel injection system.

The fuel injection system is an electronic controlled fuel injection system for multi-cylinder diesel engine. The system has a plurality of fuel injectors 1–4 mounted on respective cylinders of the multi-cylinder diesel engine. The embodiment shows a four-cylinder engine. The system has a common rail 5 serving as an accumulator vessel for accumulating fuel pressurized in high pressure corresponding to a fuel injection pressure. The system has a supply pump 7 of a variable delivery type which pressurizes fuel pumped up from a fuel tank 6. The supply pump 7 discharges pressurized fuel into the common rail 5. The system has an electronic control unit (ECU) 10 which controls the injectors 1–4 and the supply pump 7 electronically.

The injectors 1–4 are connected respectively to high-pressure pipes 8. The high-pressure 8 are branch pipes branching from the common rail 5. The injectors 1–4 inject the high-pressure fuel accumulated in the common rail 5 into combustion chambers in the engine cylinders.

The injectors 1–4 are electromagnetic fuel injection valves. Each of the injectors is constituted with a fuel injection nozzle, a needle, and an operating mechanism for the needle. The nozzle has at least one of injection hole and has a valve seat. The needle is housed in the nozzle and movable in axial direction to open and close the injection hole. The needle is a valve element cooperates with the valve seat. The operating mechanism operates the needle in axial direction. The operating mechanism has pressure chambers for obtaining fuel pressure onto the needle, a resilient urging means and an electromagnetic valve. The resilient urging means may be provided by a spring that urges the nozzle needle in a valve closing direction. The electromagnetic valve controls a pressure in the chambers so as to operate the needle in opening direction. In FIGS. 1, 11, 12, 13 and 14 denote the electromagnetic valves. The electromagnetic valve serves as an actuator for controlling the injector.

An amount of fuel to be injected into the combustion chambers and a timing of the injection can be adjusted by controlling ON and OFF of the electromagnetic valves 11–14 via the ECU 10. In this aspect, the electromagnetic valves 11–14 and the ECU 10 work as means for changing injection period. More specifically, while the electromagnetic valve is open, the pressure in back pressure control chamber for the needle is withdrawn and the needle lifts from respective valve seat, whereby the high-pressure fuel accumulated within the common rail 5 is injected from the nozzle hole of the nozzle into the combustion chamber. The longer the injection period from valve opening to valve closing of the injector is, the larger the amount of fuel injected into the combustion chamber. On the other hand, the shorter the injection period from valve opening to valve closing of the injector is, the smaller the amount of fuel injected into the combustion chamber.

It is necessary that a high pressure corresponding to the fuel injection pressure be accumulated continuously in the common rail 5. To meet this requirement, the common rail 5 is connected through a fuel pipe 18 to a discharge port of the supply pump 7. The common rail 5, the pipes 8, and the pipe 18 are high-pressure fuel passages. Fuel leaking from the injectors 1–4 and fuel leaking from the supply pump 7 are returned to the fuel tank 6 through return pipes 9. The return pipes 9 are so called as leak pipes, relief pipes, or low-pressure fuel passages. Further, a pressure limiter 15 is attached to a return pipe 9 which is for the relief of fuel from the common rail 5 to the fuel tank 6. The pressure limiter 15 releases fuel from the common rail 5 so as to limit the fuel pressure in the common rail 5 below an upper limit pressure. The upper limit pressure is preset in accordance with pressure resistant of components.

The supply pump 7 is constituted as a high-pressure feed pump. The supply pump 7 includes a high-pressure pump section and a feed pump that is a low-pressure feed pump for introducing fuel from the fuel tank 6 via a fuel pipe 17 and a fuel filter 16. The supply pump 7 has a pump drive shaft being adapted to rotate with rotation of an engine crankshaft. The pump drive shaft drives the high-pressure pump section and the feed pump. The fuel introduced by the feed pump is supplied to the high-pressure pump section. The high-pressure pump section pressurizes fuel and discharges the pressurized fuel into the common rail 5 via a discharge port and the fuel pipe 18.

An electromagnetic valve 19 as an actuator is attached to the supply pump 7. The electromagnetic valve 19 is a fuel injection pressure changing means which is controlled electronically with a control signal provided from ECU 10. The electromagnetic valve 19 adjusts the amount of fuel supplied from the supply pump 7 to the common rail 5, thereby changing the injection pressure of fuel to be injected from the injectors 1–4. The electromagnetic valve 19 may be a suction control valve that is disposed between the feed pump and the high-pressure pump section and controls amount of fuel introduced into the high-pressure pump section.

The ECU 10 corresponds to all of the following means defined in the present invention. The ECU 10 provides means for detecting engine revolution speed, means for calculating engine revolution speed change, means for updating correction amount, and means for calculating initial correction amount. The ECU 10 includes a microcomputer for performing a control device. The ECU 10 includes a CPU which carries out control processing and arithmetic processings, memories such as RAM, ROM for the storage of various control programs and data and stand-by RAM, input circuit, output circuit, power supply circuit, and injector drive circuit (EDU) 20. The memories works as correction amount storage means for storing correction amount. The EDU 20 used in this embodiment is constructed so that upon receipt of a control signal from ECU 10 controls the state of current flow to the electromagnetic valves 11–14 in the injectors 1–4 so as to open or close the valves in accordance with injection timing and fuel injection amount both calculated by the ECU 10.

The system has the following sensors connected to an input side of the ECU 10 so as to input engine parameters indicative of engine operating conditions. A cylinder identifying sensor 21 detects a rotational angle of a cam shaft in the engine to identify a cylinder for fuel injection and outputs a signal G. A crank angle sensor 22 detects a rotational angle of an engine crankshaft and outputs a signal NE. An accelerator position sensor detects a depression amount of an accelerator pedal, accelerator position and outputs a signal ACCP. A cooling water temperature sensor 24 detects the temperature of engine cooling water and outputs a signal thw. The cooling water temperature sensor 24 is means for detecting engine temperature. A fuel temperature sensor 25 detects the temperature of fuel sucked into the supply pump 7 and outputs a signal thf. A common rail pressure sensor 26 detects a fuel pressure in the common rail 5 and outputs a signal Pc.

The cylinder identifying sensor 21 has a signal rotor and a pickup. The signal rotor rotates correspondingly to an engine camshaft. The signal rotor has convex teeth correspondingly to reference crank angle indicative of reference stroke of the cylinders. The pickup may be an electromagnetic pickup or magnetic sensor such as Hall effect device. The pickup generates the signal G characterized by pulses corresponding to the convex teeth. One of the convex teeth is formed in a different profile for indicating a specific cylinder such as the first cylinder of the engine. For example, one of the teeth corresponding to the first cylinder is wider in the rotation direction than the other convex teeth or comprises plural convex teeth. To be more specific, a reference cylinder pulse G1 of the signal G is provided longer than the interval during which the signal NE is generated twice, while other pulse G2, G3, G4 of the signal G are provided shorter than the twice-generation interval of the signal NE.

Figure 3A:
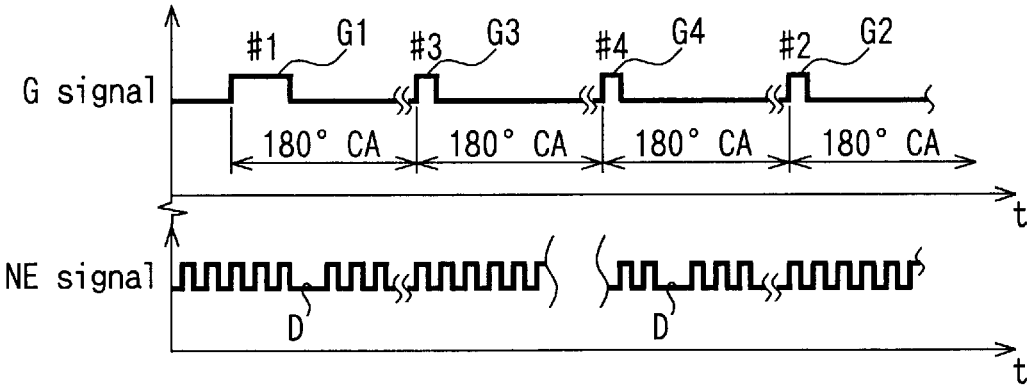
FIG. 3A is a time chart showing waveforms of sensors according to the first embodiment of the present invention.
Figure 3B:
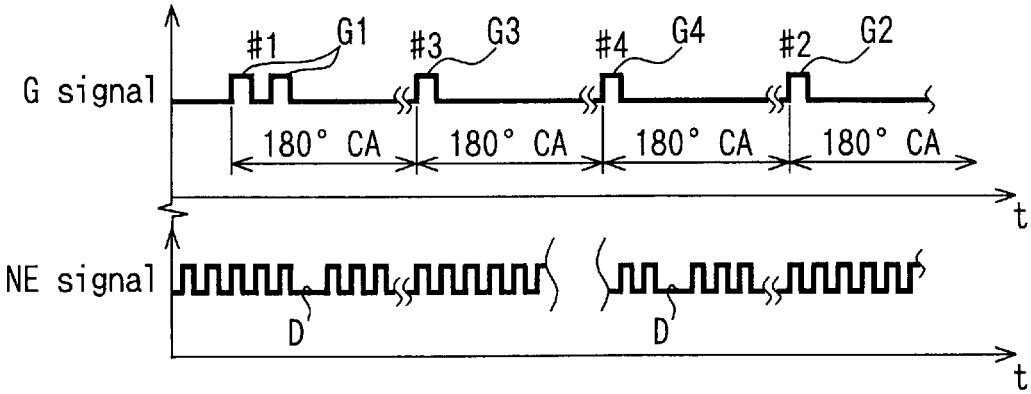
FIG. 3B is a time chart showing waveforms of sensors according to a modification of the first embodiment of the present invention.

According to the above construction, with rotation of the cam shaft, the cylinder identifying sensor 21 outputs such a waveform signal as shown in FIG. 3A or 3B. That is, a wide pulse G1 of the signal G or plural pulses G1 of the signal G are outputted upon arrival of the first piston in the first cylinder at a position just before fuel injection. Then, a narrow pulse G3 of the signal G is outputted upon arrival of a third piston in a third cylinder at a position just before fuel injection, a narrow pulse G4 of the signal G is outputted upon arrival of a fourth piston in a fourth cylinder at a position just before fuel injection, and a narrow pulse G2 of the signal G is outputted upon arrival of a second piston in a second cylinder at a position just before fuel injection.

The crank angle sensor 22 includes a signal rotor and a pickup. The signal rotor is adapted to rotate once while the crankshaft rotates once. The signal rotor has convex teeth for crank angle detection formed in a large number. The pickup generates the signal NE. The signal rotor is formed with an untoothed portion, one convex tooth-free portion, at a position just after generation of the reference cylinder pulse of the signal G to generate an untoothed signal D with a large width. This untoothed portion is also formed at a 180° opposed position so that the untoothed signal is generated just after generation of the reference cylinder pulse of the signal G for detecting the first piston in the first cylinder and also just after generation of the pulse of the signal G for detecting the fourth piston in the fourth cylinder.

According to the above construction, as the crankshaft rotates, the crank angle sensor 22 outputs such a waveform signal as shown in FIG. 3A or 3B. That is, the signal NE of a small width, which are continuous at a predetermined angle, are outputted repeatedly with the exception that the untoothed pulse D is generated. The ECU 10 used in this embodiment detects the engine revolution speed NE, engine speed, by measuring an interval time between the pulses of the signal NE.

In a steady driving mode of the engine, the ECU 10 calculates an injection timing of each of the injectors 1–4 and a discharge amount of the supply pump 7 on the basis of the inputted signals.

The ECU 10 adjusts turn on timing and turn off timing of current supply for the electromagnetic valve 19 in the supply pump 7 so as to maintain the fuel injection pressure at an optimum pressure, that is target common rail pressure.

Further, the ECU 10 calculates a base injection amount q on the basis of operating conditions of the engine, i.e., engine speed NE, accelerator position ACCP, cooling water temperature thw, and fuel temperature thf. Then, the ECU 10 calculates an injection command value, injection pulse width, Tq on the basis of both the base injection amount q and a common rail pressure Pc. The ECU 10 applies a pulse-like injector driving current proportional to the thus-calculated injection command value Tq to the electromagnetic valves 11–14 each independently. The pulse signal supplied for the electromagnetic valves 11–14 are so called as TQ pulses. As a result, the engine is operated.

The ECU 10 used in this embodiment is constructed so as to execute a non-uniform fuel amount compensating control, the FCCB control. In the FCCB control, the ECU 10 performs a fine adjustment to the injection amounts injected from respective injectors 1–4 so as to smooth the engine speed when the engine is in an idling mode, stable idling state. More specifically, the ECU 10 detects an engine revolution speed change in each combustion stroke in each engine cylinder. Then, the ECU 10 compares the thus-detected value with a target value such as a mean value of engine revolution speed changes in all the cylinders. Finally, the ECU 10 adjusts the fuel injection amount to an optimum value for each cylinder in an independent manner to suppress deviation of the engine speed.

More specifically, an instantaneous engine revolution speed in each combustion stroke in each engine cylinder is calculated by calculating an interval time of the signal NE. A maximum value of the interval time of the signal NE between BTDC90°CA and ATDC90°CA is sampled and stored as a value indicative of a minimum engine revolution speed Nl of the instantaneous engine revolution speed of the given cylinder. A minimum value of the interval time of the signal NE between BTDC90°CA and ATDC90°CA is also sampled and stored as a value indicative of a maximum engine revolution speed Nh of the instantaneous engine revolution speed of the given cylinder.

After these calculations have been conducted for each cylinder, a cylinder-by-cylinder revolution difference ΔNk between the maximum revolution Nh and the minimum revolution Nl is calculated in each cylinder. As a result, the engine revolution speed change in each cylinder are calculated. Then, a mean value ΣΔNk/n of the revolution differences in all the engine cylinders is calculated. That is, the engine revolution speed changes in all the cylinders are averaged to afford a mean value. Thereafter a deviation dΔNk of the engine revolution speed change in each cylinder is calculated on the basis of the revolution difference ΔNk and the mean value ΣΔNk/n. Then, the fuel injection amount for each cylinder in the engine is corrected so as to smooth the engine revolution speed change between the cylinders in the engine. In this process, the mean value ΣΔNk/n may be a target value or a predetermined value may be a target value for correcting the fuel injection amount for smoothing the engine revolution speed.

Figure 4:
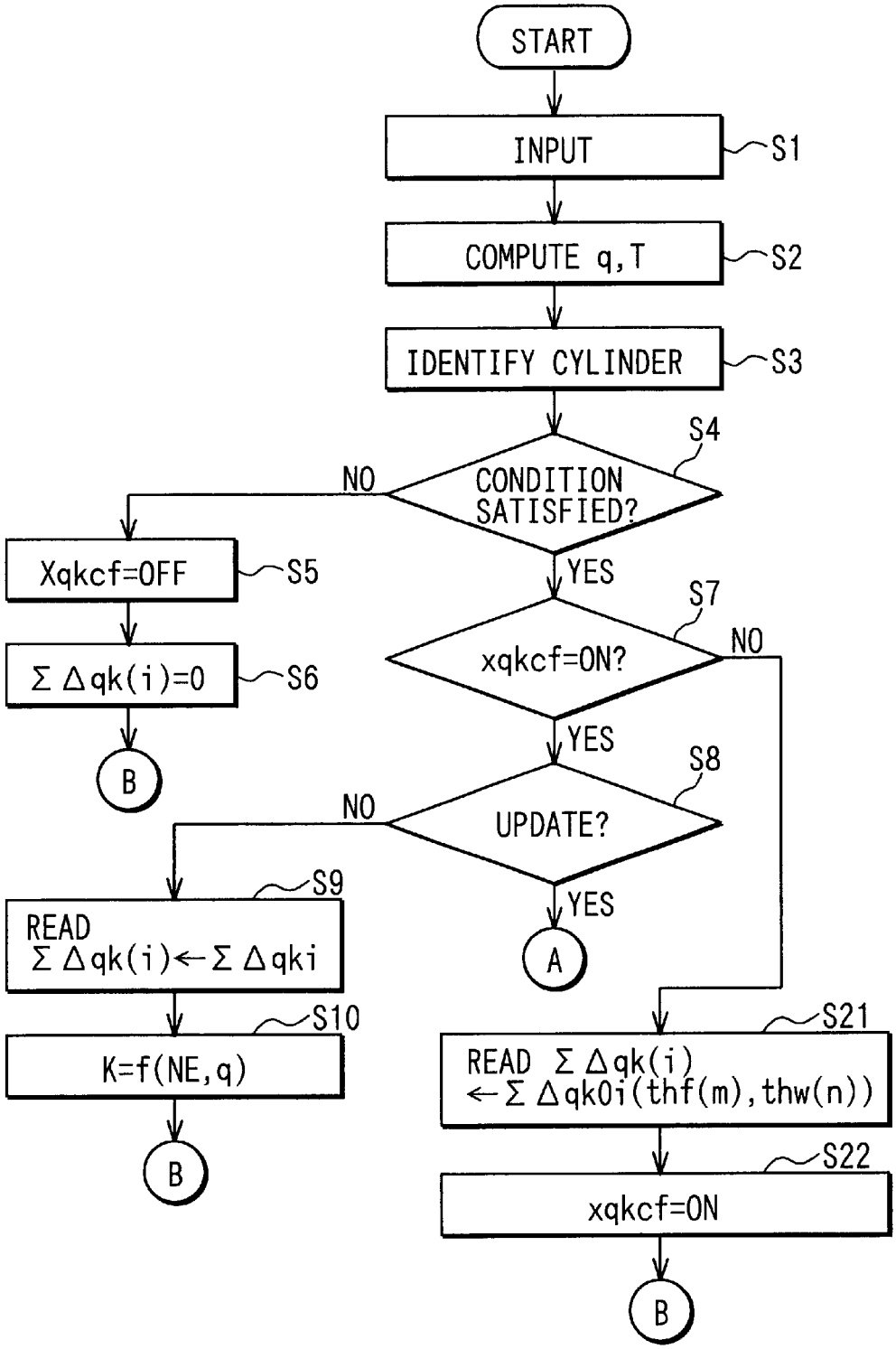
FIG. 4 is a flow chart showing an injection amount control according to the first embodiment of the present invention.
Figure 5:
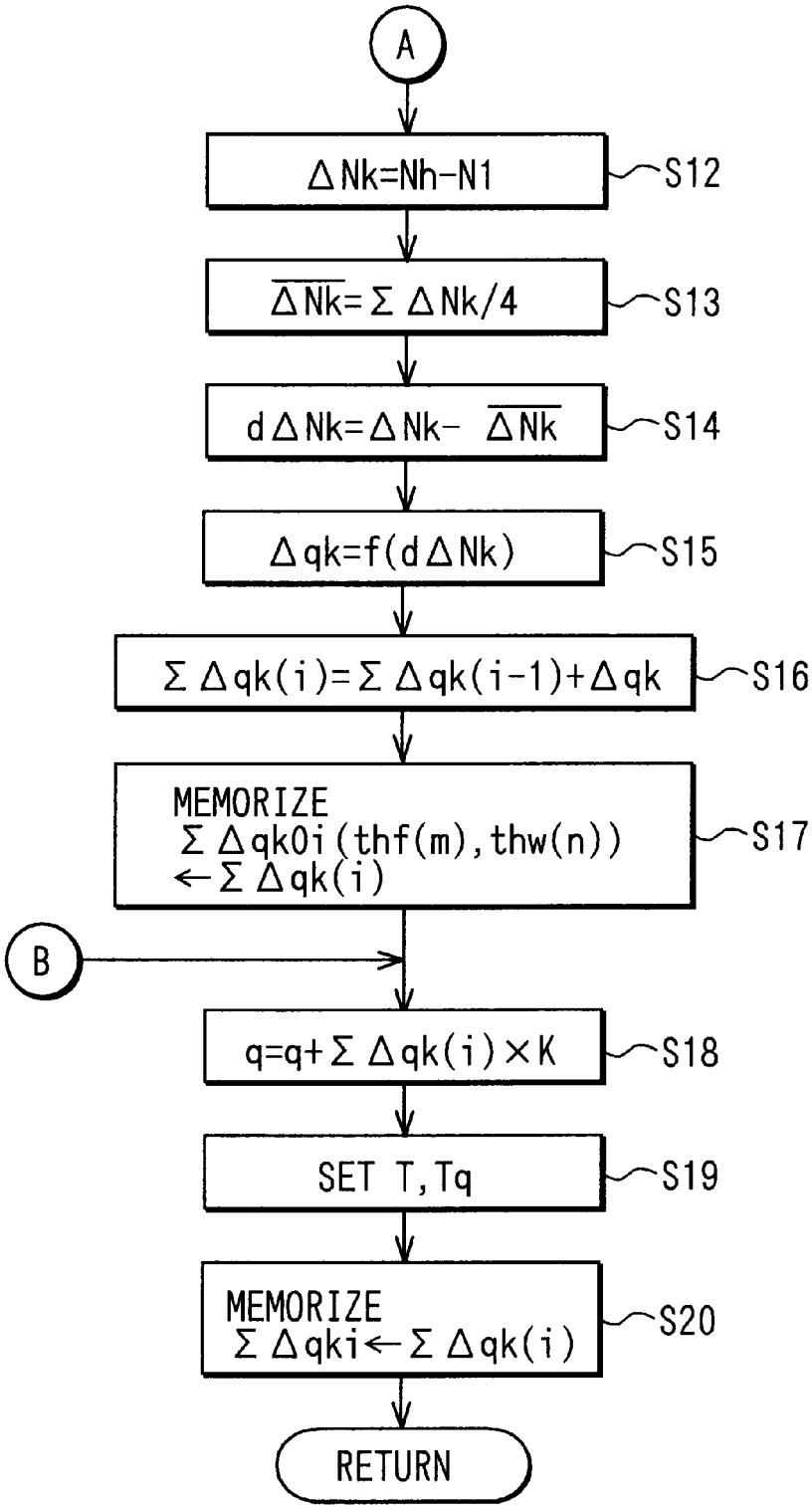
FIG. 5 is a flow chart showing the injection amount control according to the first embodiment of the present invention.

Next, with reference to FIGS. 1 to 6, a brief description will be given below about an injection amount control method for the injectors 1–4 used in this embodiment. FIGS. 4 and 5 are flow charts illustrating the injection amount control method.

When an ignition switch is turned ON to supply power to the ECU 10, the routine shown in FIGS. 4 and 5 starts. First, engine parameters are inputted from the sensors. More particularly, the signals G, NE, ACCP, thw, thf and Pc are inputted. Further the engine revolution speed NE is calculated by measuring the interval time of pulses of the signal NE (step S1).

Next, a base injection amount q and an injection timing T of the injectors 1–4 are calculated based on the inputted signals (step S2). The base injection amount q is a target injection amount to be injected into the combustion chamber so as to maintain the engine output in accordance with the engine operating condition. This process works as means for calculating injection amount and/or injection timing.

Next, the cylinder in which fuel is to be injected is identified based on the signal G and signal NE. The identified cylinder is denoted as k cylinder (step S3). This process works as means for identifying cylinder. Then, a check is made to see if the cylinder-by-cylinder injection correction amount reflecting condition exists (ON) or not (step S4). The cylinder-by-cylinder injection correction amount reflecting condition is the FCCB condition. If the answer is negative, that is, if the condition is OFF, it is judged that the driver has shifted the vehicular operation from idling mode to vehicular running, and a FCCB flag xqkcf is turned OFF (step S5).

Next, the cylinder-by-cylinder injection correction amount ΣΔqk(i) is cleared (step S6). Thereafter, the processing flow advances to step S18. the cylinder-by-cylinder injection correction amount ΣΔqk(i) is also called as a FCCB amount or an injection correction amount for the cylinder concerned.

If the answer in step S4 is affirmative, that is, a check is made to see if the FCCB condition was existent last time or not by referencing the FCCB flag xqkcf (step S7). If the FCCB flag xqkcf has been already turned on, it is judged whether an updating condition exists (ON) or not. More particularly, it is determined whether or not the engine is in a stable idling state (step S8). For instance, if the engine revolution speed NE is a predetermined value or less, e.g., an idling speed of 850 rpm or so the determination will be YES.

If the answer in step S8 is negative, the injection correction amount ΣΔqki up to the last time which was stored is read out (step S9). A correction coefficient K corresponding to the present engine operating condition is calculated (step S10). For example, the correction coefficient K is obtained by K=f(NE, q). Then, the cylinder-by-cylinder injection correction amount ΣΔqk(i) is corrected based on the correction coefficient K (step S18). Simultaneously, the cylinder-by-cylinder injection correction amount ΣΔqk(i) and the correction coefficient K is reflected to a determining process of a final injection amount q in the step S8.

If the answer in step S8 is affirmative, that is, if the updating condition is satisfied, the revolution difference ΔNk between a maximum engine revolution speed Nh and a minimum engine revolution speed Nl in each cylinder is calculated. The maximum engine revolution speed Nh and the minimum engine revolution speed Nl are sampled and stored corresponding to each cylinder. Those values are indicative of combustion power of given cylinder. That is, a detected value of the engine revolution speed change in each engine cylinder is calculated (step S12). This process is provided as means for detecting engine revolution speed change of each cylinder.

Next, a mean value ΣΔNk/n of the revolution differences is calculated, that is, a mean value of engine revolution speed changes in all the engine cylinders is calculated (step S13). In this embodiment, the mean value ΣΔNk/n is obtained by ΣΔNk/n=(ΔN1+ΔN2+ΔN3+ΔN4)/4. The mean value can be calculated in every cycle of the engine or every predetermined cycles of the engine. Then, a deviation dΔNk of the engine revolution speed change in each cylinder is calculated from both the detected value ΔNk and the mean value ΣΔNk/n (step S14). This process is provided as means for calculating an engine revolution speed change of each cylinder. For example, the deviation dΔN1 of the first cylinder may be calculated as dΔN1=ΣΔNk/n−ΔN1, where ΔN1 is a detected revolution difference of the first cylinder. The deviation of the other cylinders may be obtained in the same manner.

Next, an injection correction amount Δqk of this time for the cylinder concerned is calculated from the value calculated in step S14, (step S15). The injection correction amount Δqk for given cylinder can be obtained by Δqk=f(dΔNk), where f is a predetermined functional expression. The injection correction amount ΣΔqk(i-1) up to the last time for the cylinder concerned and the injection correction amount Δqk of this time for the cylinder concerned are added to update the cylinder-by-cylinder injection correction amount ΣΔqk(i) (step S16). This process is provided as means for updating the injection correction amount. Next, the cylinder-by-cylinder injection correction amount ΣΔqk (i) is stored into a storage corresponding to the cylinder concerned (step S17). The cylinder-by-cylinder injection correction amount ΣΔqk(i) is stored in a two-dimensional map defined by the water temperature thw and the fuel temperature thf as shown in FIG. 6. The map is assembled for each cylinder. This process works as means for storing the correction amount into storage device. As a result, the ECU 10 stores cylinder-by-cylinder injection correction amount ΣΔqk(i) that reflects temperature conditions of the engine and accumulates such date for entire engine operation condition.

Then, the cylinder-by-cylinder injection correction amount ΣΔqk(i) is reflected in the base injection amount q calculated in step S2. In step S18, the final injection amount q is determined based on the base injection amount q calculated in the step S2, the cylinder-by-cylinder injection correction amount ΣΔqk(i) determined in one of the steps S6, S9, S16 and S21, and the correction coefficient K. Then the final injection amount q in step S18 is converted into an injection amount command value such as a valve opening command value, a valve closing command value, an injection timing T and an injection pulse width Tq. Then the injection amount commend value is set to an output stage (step S19).

The cylinder-by-cylinder injection correction amount $\Sigma\Delta qk(i)$ is stored as the value $\Sigma\Delta qki$ (step S20).

In case of incrementing the injection amount command value in response to the injection correction amount, only the valve closing timing of the injectors 1–4 are delayed to extend the fuel injection period, while the valve opening timing of the injectors 1–4 are maintained. In case of decrementing the injection amount command value in response to the injection correction amount, only the valve closing timing of the injectors 1–4 are advanced to shorted the fuel injection period, while the valve opening timing of the injectors 1–4 are maintained.

If the answer in step S7 is NO, that is, if the FCCB flag (xqkcf) is OFF, an initial value of the injection correction amount for the cylinder concerned is calculated from storage data. The initial value of the injection correction amount $\Sigma\Delta qk(i)$ is obtained by looking up the map as shown in FIG. 6. That is, the injection correction amount is obtained by $\Sigma\Delta qk(i)=\Sigma\Delta qk0i(thf(m), thw(n))$ (step S21). Here, thf(m) is a present value of the fuel temperature, and thw(n) is a present value of the cooling water temperature. As a result, it is possible to obtain an initial value of the injection correction amount that reflects the present engine condition just after the FCCB condition is established.

Next, the FCCB flag xqkcf is turned ON (step S22). Thereafter, the processing flow advances to the step S18.

As in the prior art, when the FCCB flag (xqkcf) has changed from ON to OFF, that is, when the driver has shifted the vehicular operation mode from idling to running mode and the FCCB condition has changed from existence to non-existence, the contents of learning (updating) the injection correction amount $\Sigma\Delta qk(i)$ or the like for each cylinder of the last time with respect to the time when the condition became existent are held (stored) in memory such as a stand-by RAM.

However, for example in the case where the contents of learning (updating) the injection correction amount $\Sigma\Delta qk(i)$ or the like for each cylinder are held (stored) in memory such as a stand-by RAM during idling just before engine stop in a complete warm-up state, and if the water temperature condition (thw) in the engine is a cold condition less than or equal to a predetermined value during idling just after next-time start-up of the engine, i.e., at the time of turning on of the FCCB condition, even if the FCCB condition turns ON, there arises the problem that engine vibration offends the driver until the FCCB amount $\Sigma\Delta qk(i)$ is newly updated and held (stored), i.e., in an initial stage wherein the FCCB condition was established.

Or during idling upon lapse of a predetermined time after vehicular running (the FCCB condition is OFF) just after start-up of the engine in the cold, i.e., at the time of turning on of the FCCB condition, if the engine water temperature (thw) condition is a warm water condition equal to or more than a predetermined value, then as above there arises the problem that engine vibration offends the driver until the FCCB amount $\Sigma\Delta qk(i)$ is newly updated.

If the temperature environment, including engine water temperature (thw) and fuel temperature (thf), varies, there may occur a difference in friction sensitivity for example due to variations in engine cylinders (including bore, piston and piston ring) or a difference in fuel temperature characteristic of fuel injection due to variations in clearance of interior finish components of the injectors 1–4, with a consequent difference in the engine revolution speed change between engine cylinders and a more marked vibration of the engine.

On the contrary, in this embodiment, it is possible to resolve the problem when the FCCB condition is established. In the embodiment, the injection correction amount for smoothing the engine revolution speed change between engine cylinders is stored in storage data which is constituted by a two-dimensional map of the engine water temperature thw and the fuel temperature thf as shown in FIG. 6. Then, an initial value of the injection correction amount just after the FCCB condition is established is obtained from the stored data in accordance with the temperature condition of the engine when the FCCB condition is established. The FCCB control is performed on the basis of the initial value obtained by looking up the stored data.

Figure 7:
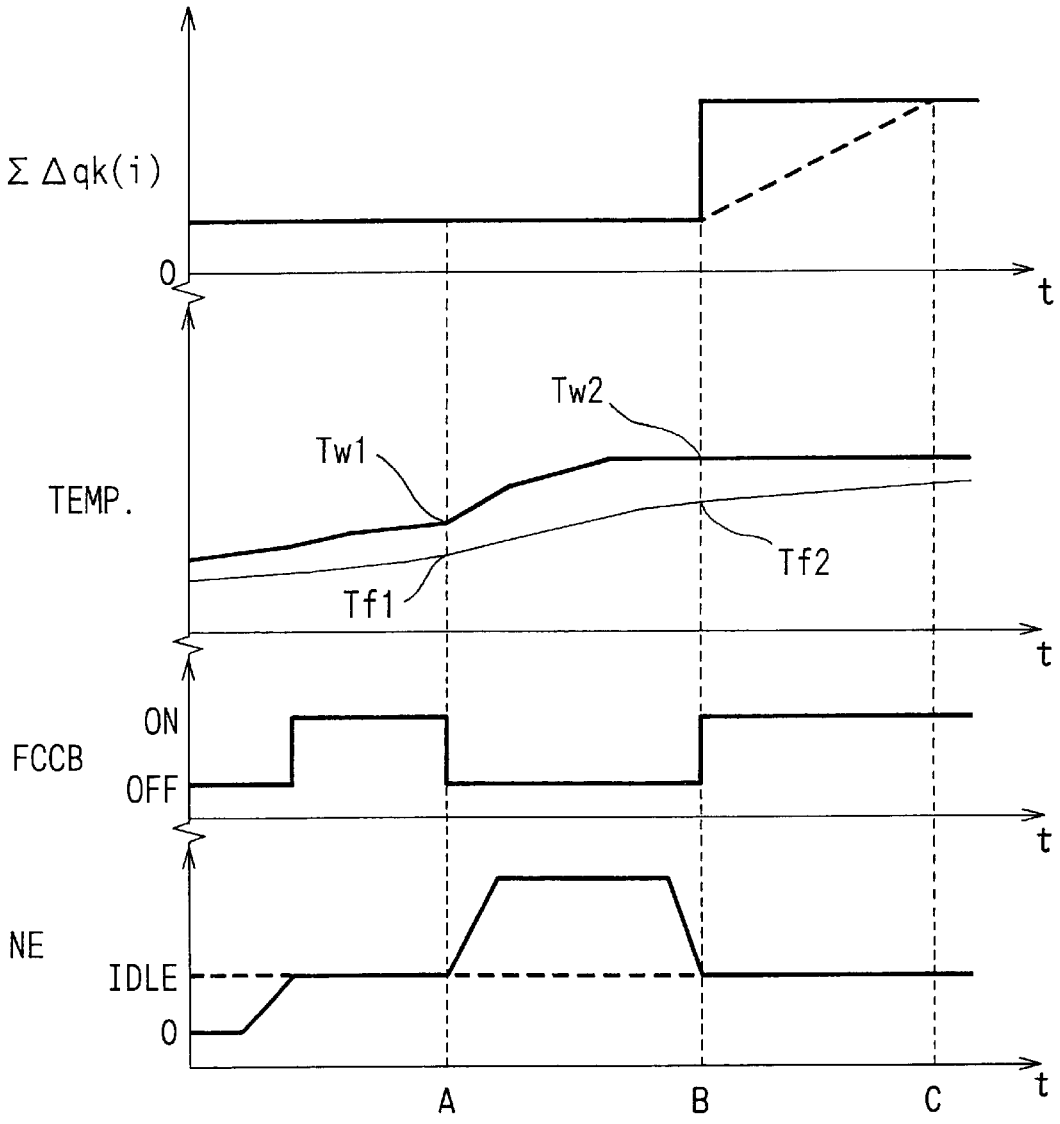
FIG. 7 is a time chart showing an operation of the fuel injection system according to the first embodiment of the present invention.

FIG. 7 shows an operation of the embodiment. In FIG. 7, the engine is started on the left end, then the engine revolution speed NE reaches to a stable idling speed and the FCCB condition is established and turns ON. During the FCCB condition is maintained ON, the FCCB control is performed to suppress vibration of the engine. Then, the driver accelerates the engine from the timing A to the timing B, the FCCB condition is turned off. When the FCCB condition is established again at the timing B, the temperature condition of the engine has been changed since the FCCB condition is turned off. The cooling water temperature has been increased from Tw1 to Tw2. Similarly, the fuel temperature has been increased from Tf1 to Tf2. According to the embodiment, the initial value of the injection correction amount $\Sigma\Delta qk(i)$ is obtained in accordance with the temperature Tw2 and Tf2. Therefore, it is possible to obtain a proper level of the injection correction amount just after the FCCB condition is turned on. On the contrary, if the conventional FCCB control is performed after the timing B, the injection correction amount $\Sigma\Delta qk(i)$ is gradually changed to a proper level.

According to the embodiment, it is possible to start or resume the engine vibration suppressing control (the FCCB control) just after the FCCB condition is established with proper level of the injection correction amount.

Although in the above embodiment the present invention is applied to an electronic controlled common rail type fuel injection system for a multi-cylinder diesel engine, the present invention may also be applied to an electronic controlled fuel injection system for a multi-cylinder diesel engine not having a common rail but constituted by a distribution type fuel injection pump or an in-line fuel injection pump.

Although the engine referred to in the above embodiment is a four-cylinder diesel engine, a diesel engine of two, six, eight or more cylinders may be adopted. A gasoline engine of two or more cylinders may also be adopted. In this case, each injector as an electromagnetic fuel injection valve may be attached to an intake pipe located upstream of an intake port in each cylinder.

In the above embodiment, the data is stored in the stand-by RAM that is capable of maintaining stored data during an OFF condition of the ignition switch. However, EPROM, EEPROM, flash memory, or another storage medium such as DVD-ROM, CD-ROM, and flexible disc, may be used instead of the stand-by RAM.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A fuel injection system comprising:

fuel injectors provided for each of cylinders in an internal combustion engine, the fuel injectors supply fuel to each of the cylinders;

a temperature detecting means for detecting temperature relating to an operating condition of the internal combustion engine;

base control means for controlling the fuel injectors so that each of the cylinders is supplied with base injection amounts;

correcting means for correcting the base injection amounts based on injection correction amounts so as to suppress the engine revolution speed change caused by differences of combustion power between the cylinders;

storing means for storing the injection correction amount in connection with the temperature detected by the temperature detecting means; and initial value obtaining means for obtaining an initial value of the injection correction amount in the correcting means when the correcting means starts or resumes the correcting process, the initial value of the injection correction amount is obtained on the basis of the stored value of the injection correction amount in the storing means.

2. The fuel injection system according to claim 1, wherein the temperature detecting means includes:

engine temperature detecting means for detecting temperature relating to the internal combustion engine; and fuel temperature detecting means for detecting temperature of the fuel which is injected through the injectors.

3. The fuel injection system according to claim 2, wherein the correcting means corrects the injection amount when the correcting means is permitted to correct the injection amount.

4. The fuel injection system according to claim 3, wherein the correcting means includes:

engine revolution speed detecting means for detecting an engine revolution speed in each combustion stroke of each of the cylinders;

engine revolution speed change calculating means for calculating engine revolution speed change in each of the cylinders on the basis of a maximum engine revolution speed and a minimum engine revolution speed in each combustion stroke of each of the cylinders;

target obtaining means for obtaining a target engine revolution speed change for all of the cylinders;

deviation calculating means for calculating deviations of the engine revolution speed changes from the target engine revolution speed change;

injection correction amount determining means for determining the injection correction amounts of each of the cylinders in accordance with the deviations of each of the cylinders respectively; and injection amount correcting means for correcting the injection amount in accordance with the injection correction amount.

5. The fuel injection system according to claim 4, wherein the target obtaining means calculates a mean value of the engine revolution speed changes in all of the cylinders as the target engine revolution speed change.

6. The fuel injection system according to claim 5, wherein the storing means stores the injection correction amount in a map defined by the engine temperature and the fuel temperature.

7. The fuel injection system according to claim 6, wherein the initial value obtaining means obtains the initial value when the correcting means is permitted to correct the injection amount this time but the correcting means was not permitted to correct the injection amount.

8. The fuel injection system according to claim 7, wherein the initial value obtaining means obtains the initial value in accordance with a present value of the engine temperature and a present value of the fuel temperature.

9. The fuel injection system according to claim 1, wherein the initial value obtaining means obtains the initial value when a predetermined condition was not existent last time but is existent this time.

10. The fuel injection system according to claim 9, wherein the initial value obtaining means obtains the initial value when the predetermined condition is established for the first time after start-up of the internal combustion engine, or when the predetermined condition is established just after start-up of the internal combustion engine under a cold condition after a stop of the internal combustion engine completely warmed, or when the predetermined condition is established after travel of a vehicle concerned just after start-up of the internal combustion engine under the cold condition.

11. The fuel injection system according to claim 1, wherein the correcting means corrects the base injection amounts when the engine revolution speed is a predetermined value or less.

12. The fuel injection system according to claim 1, wherein the correcting means corrects the base injection amounts when the vehicle running speed is a predetermined value or less.

13. The fuel injection system according to claim 11, wherein the correcting means functions as a non-uniform fuel amount compensating control which adjusts the fuel injection amount of each of the cylinders to an optimum amount.

14. The fuel injection system according to claim 13, wherein the correcting means corrects the base injection amounts so as to suppress engine vibration.

* * * * *